US007421843B2

(12) United States Patent
Laster et al.

(10) Patent No.: US 7,421,843 B2
(45) Date of Patent: Sep. 9, 2008

(54) CATALYTIC COMBUSTOR HAVING FUEL FLOW CONTROL RESPONSIVE TO MEASURED COMBUSTION PARAMETERS

(75) Inventors: Walter Ray Laster, Oviedo, FL (US); Ramarao V. Bandaru, Oviedo, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 559 days.

(21) Appl. No.: 11/035,561

(22) Filed: Jan. 15, 2005

(65) Prior Publication Data

US 2006/0156735 A1 Jul. 20, 2006

(51) Int. Cl.
*F02C 7/22* (2006.01)
*F02C 7/26* (2006.01)

(52) U.S. Cl. ..... 60/777; 60/723

(58) Field of Classification Search ..... 60/723, 60/777, 39.822

See application file for complete search history.

(56) References Cited

U.S. PATENT DOCUMENTS 4,173,118 A * 11/1979 Kawaguchi ..... 60/733
4,365,477 A * 12/1982 Pearce ..... 60/737
4,887,432 A * 12/1989 Mumford et al. ..... 60/759
4,926,645 A * 5/1990 Iwai et al. ..... 60/723
5,000,004 A * 3/1991 Yamanaka et al. ..... 60/723
5,003,768 A * 4/1991 Kappler et al. ..... 60/39.23
5,161,366 A * 11/1992 Beebe ..... 60/777
5,165,224 A * 11/1992 Spadaccini et al. ..... 60/780
5,381,652 A 1/1995 Mezzedimi et al.
5,394,688 A 3/1995 Amos
5,431,017 A * 7/1995 Kobayashi et al. ..... 60/723
5,452,574 A * 9/1995 Cowell et al. ..... 60/39.23
5,461,864 A * 10/1995 Betta et al. ..... 60/723
5,488,829 A * 2/1996 Southall et al. ..... 60/725
5,623,819 A * 4/1997 Bowker et al. ..... 60/776
5,626,017 A * 5/1997 Sattelmayer ..... 60/723
5,674,066 A 10/1997 Hausermann et al.
5,826,429 A 10/1998 Beebe et al.
5,850,731 A 12/1998 Beebe et al.
5,946,917 A * 9/1999 Hums et al. ..... 60/723
6,095,793 A * 8/2000 Greeb ..... 431/12
6,109,018 A * 8/2000 Rostrup-Nielsen et al. .... 60/777
6,155,820 A 12/2000 Dobbeling et al.
6,174,159 B1 1/2001 Smith et al.
6,205,789 B1 3/2001 Patterson et al.
6,279,323 B1 8/2001 Monty et al.
6,289,667 B1 * 9/2001 Kolaczkowski et al. ..... 60/777
6,405,536 B1 6/2002 Ho et al.

(Continued)

*Primary Examiner*—William H Rodriguez

(57) ABSTRACT

A gas turbine combustor (23) includes a catalytic combustion stage (22) receiving a first portion (18) of a total oxidizer flow (16) and a first portion (30) of a total fuel flow (29) and discharging a partially oxidized fuel/oxidizer mixture (40) into a post catalytic combustion stage (24) defined by a combustion liner (58). The combustor further includes an injector scoop (54) having an injector scoop inlet (56) in fluid communication with an opening (56) in the combustion liner for receiving a second portion (20) of the oxidizer flow. A fuel outlet (e.g. 64) selectively supplies a second portion (42) of the total fuel flow into the second portion of the oxidizer flow. The injector scoop includes an injector scoop outlet (66) in fluid communication with the post catalytic combustion stage and discharges a fuel/oxidizer mixture (44) into the partially combusted fuel/oxidizer mixture at an angle relative to the flow axis to impart a swirl to the fuel/oxidizer mixture as it enters the post catalytic combustion stage.

13 Claims, 2 Drawing Sheets

U.S. PATENT DOCUMENTS

| | | | | |
|---|---|---|---|---|
| 6,412,282 | B1 | 7/2002 | Willis | |
| 6,415,608 | B1 | 7/2002 | Newburry | |
| 6,530,222 | B2 | 3/2003 | Stuttaford et al. | |
| 6,599,121 | B2 | 7/2003 | Gutmark et al. | |
| 6,629,414 | B2 | 10/2003 | Fischer | |
| 6,640,548 | B2 | 11/2003 | Brushwood et al. | |
| 6,675,587 | B2 | 1/2004 | Graves et al. | |
| 6,702,574 | B1 | 3/2004 | Dobbeling | |
| 6,748,745 | B2 * | 6/2004 | Ul Karim et al. | 60/777 |
| 6,923,001 | B2 * | 8/2005 | Laster et al. | 60/723 |
| 2003/0192318 | A1 | 10/2003 | Sprouse et al. | |
| 2004/0093856 | A1 * | 5/2004 | Dingle et al. | 60/286 |

* cited by examiner

CATALYTIC COMBUSTOR HAVING FUEL FLOW CONTROL RESPONSIVE TO MEASURED COMBUSTION PARAMETERS

FIELD OF THE INVENTION

This invention relates generally to gas turbines, and more particularly, to a catalytic combustor for a gas turbine.

BACKGROUND OF THE INVENTION

Catalytic combustion systems are well known in gas turbine applications to reduce the creation of pollutants, such as NOx, in the combustion process. One catalytic combustion technique known as the rich catalytic, lean burn (RCL) combustion process includes mixing fuel with a first portion of compressed air to form a rich fuel mixture. The rich fuel mixture is passed over a catalytic surface and partially oxidized, or combusted, by catalytic action. Activation of the catalytic surface is achieved when the temperature of the rich fuel mixture is elevated to a temperature at which the catalytic surface becomes active. Typically, compression raises the temperature of the air mixed with the fuel to form a rich fuel mixture having a temperature sufficiently high to activate the catalytic surface. After passing over the catalytic surface, the resulting partially oxidized rich fuel mixture is then mixed with a second portion of compressed air in a downstream combustion zone to produce a heated lean combustion mixture for completing the combustion process. Catalytic combustion reactions may produce less NOx and other pollutants, such as carbon monoxide and hydrocarbons, than pollutants produced by homogenous combustion.

U.S. Pat. No. 6,174,159 describes a catalytic oxidation method and apparatus for a gas turbine utilizing a backside cooled design. Multiple cooling conduits, such as tubes, are coated on the outside diameter with a catalytic material and are supported in a catalytic reactor. A portion of a fuel/oxidant mixture is passed over the catalyst coated cooling conduits and is oxidized, while simultaneously, a portion of the fuel/oxidant enters the multiple cooling conduits and cools the catalyst. The exothermally catalyzed fluid then exits the catalytic oxidation zone and is mixed with the cooling fluid in a downstream post catalytic oxidation zone defined by a combustor liner, creating a heated, combustible mixture.

Typically, gas turbines using catalytic combustion techniques are designed to operate using a fuel having a certain heating value within a predetermined range. The heating value is the amount of energy released when the fuel is burned. However, it may be desired to operate the gas turbine using fuels having heating values outside the predetermined range. If the heating value of the fuel is lower than the predetermined range, the flow rate of the fuel must be increased to obtain the same temperature in the combustion zone.

BRIEF DESCRIPTION OF THE DRAWINGS

The invention will be more apparent from the following description in view of the drawings that show.

DETAILED DESCRIPTION OF THE INVENTION

In some applications, it may be desired to operate a gas turbine using a fuel having a heat capacity rating lower than the rating of a fuel normally used to fire the gas turbine. For example, a gas turbine may be designed to operate efficiently with a fuel having a relatively higher heating value (high BTU rating) such as natural gas, instead of a fuel having a lower heat capacity rating (low BTU rating), such as syngas. However, to operate such a gas turbine using a lower BTU fuel, a higher flow volume of fuel may be required to maintain a desired heat output in the combustor. Fuel supply and fuel mixing channels configured for operation with a relatively high BTU rated fuel may be too small to support an additional fuel volume required to operate the gas turbine with the lower BTU fuel. Because of the comparatively large surface area required for catalytic combustion, pressure drop through the combustion system is an important design consideration. By using a lower BTU fuel, a total flow rate of fuel through a catalytic portion of a catalytic combustor will need to be increased significantly compared to using a higher BTU fuel, resulting in an unacceptable pressure drop through the catalytic portion of the catalytic combustor catalyst. Another area of concern when using a low BTU fuel is the fuel injection system of the combustor. Significant changes in the fuel flow rates will require a change in the fuel injection system to obtain an optimized fuel air mixture at the catalyst section of the combustor. Inadequate fuel mixing may result in a decrease in catalytic reaction performance and may result in overheating. The inventors of the present invention have innovatively realized that a catalytic gas turbine designed for operation with a higher BTU fuel may be operated with a lower BTU fuel by injecting a portion of the lower BTU fuel supplied to a catalytic combustor into a post catalytic combustion stage downstream of a catalytic combustion stage. Advantageously, the gas turbine may be operated using fuels having a wider range of heating values than is possible using a conventional catalytically fired gas turbine.

Figure 1:
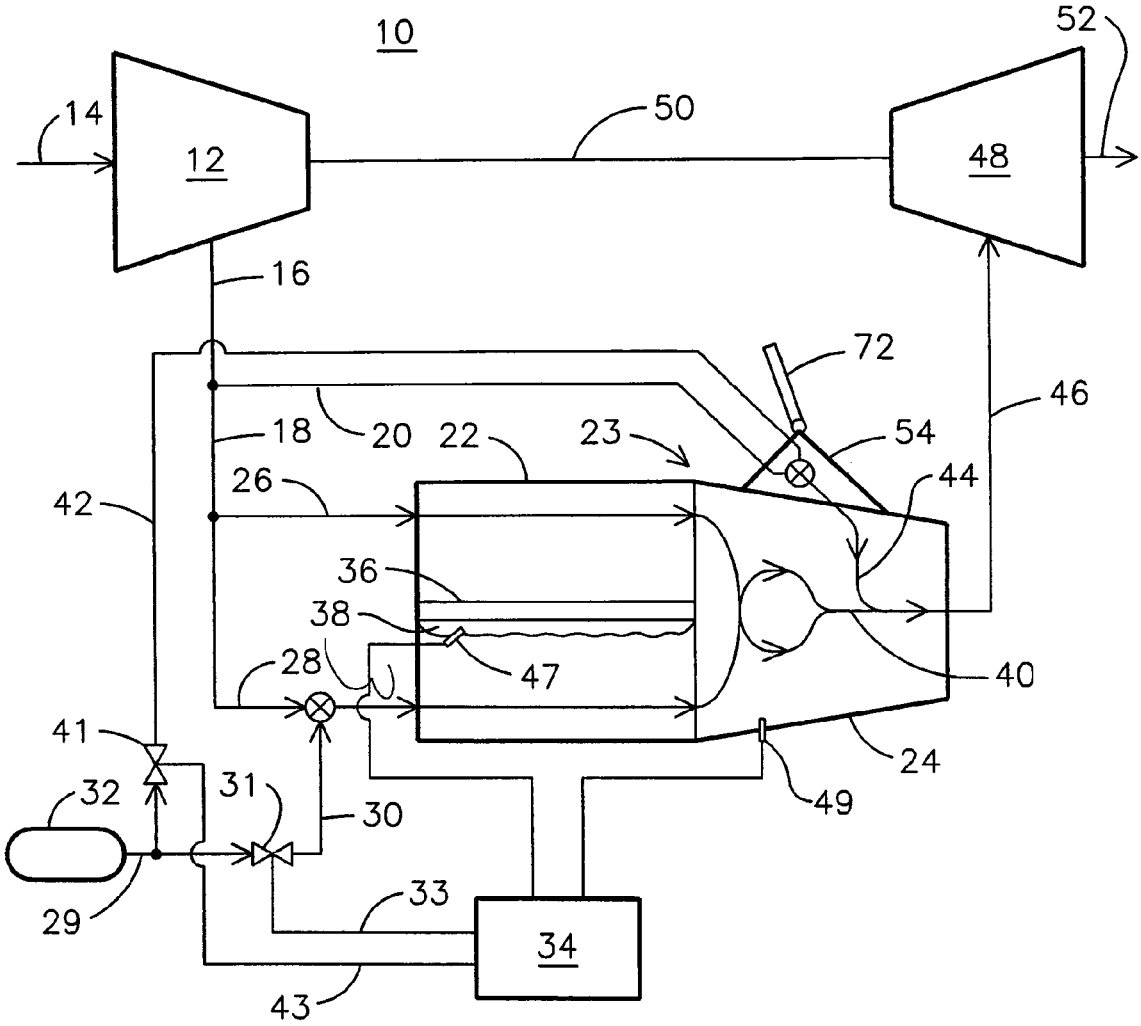
FIG. 1 is a schematic diagram of a gas turbine having a catalytic combustion stage and a post catalytic combustion stage.

FIG. 1 illustrates a gas turbine engine 10 having a compressor 12 for receiving an oxidizer flow 14, such as filtered ambient air, and for producing a compressed oxidizer flow 16. The compressed oxidizer flow 16 may be separated into a first portion 18 of the compressed oxidizer flow for introduction into a catalytic combustion stage 22 of a combustor 23, and a second portion 20 of the compressed oxidizer flow for introduction into a post catalytic combustion stage 24 of the combustor 23. The first portion 18 of the oxidizer flow may be further separated into a backside cooling air flow 26 and combustion mixture air flow 28. The combustion mixture airflow 28 is mixed with a first portion 30 of a combustible fuel 29, such as natural gas or fuel oil, for example, provided by a fuel source 32, prior to introduction into the catalytic combustion stage 22. The backside cooling air flow 26 may be introduced directly into the catalytic combustion stage 22 without mixing with a combustible fuel 29. In an aspect of the invention, the combustion mixture air flow 28 may comprise about 15% by volume of the first portion 18 of the compressed oxidizer flow 16, and the backside cooling air flow 26 may comprise about 85% by volume of the first portion 18 to achieve catalytic combustion having desired combustion parameters.

Inside the catalytic combustion stage 22, the combustion mixture air flow 28 and the backside cooling air flow 26 may be separated by a pressure boundary element 36. The pressure boundary element 36 may be coated with a catalytic material 38 on a side exposed to the combustion mixture air flow 28. While exposed to the catalytic material 38, the combustion mixture air flow 28 is partially oxidized in an exothermic reaction. The backside cooling air flow 26 passing on an opposite side of the pressure boundary element 36 absorbs a portion of the heat produced by the exothermic reaction, thereby cooling the catalytic material 38 and the pressure boundary element 36. After the flows 26,28 exit the catalytic combustion stage 22, the flows 26,28 are mixed and further combusted in the post catalytic combustion stage 24 to produce a partially combusted mixture 40.

In an aspect of the invention, a second portion 42 of the combustible fuel may be mixed with the second portion 20 of the compressed oxidizer flow 16 to form a post catalytic combustion mixture 44 for introduction into the post catalytic combustion stage 24. The second portion 42 of the combustible fuel and the second portion 20 of the compressed oxidizer flow 16 may be provided to a flow directing element, such as an injector scoop 54, for injecting the portions 20, 42 into the post catalytic combustion stage 24. The portions 20, 42 may be mixed in the scoop 54 to form the post catalytic combustion mixture 44 before being injected into the post catalytic combustion stage 24.

A controller 34, responsive to a sensor 49 monitoring a parameter responsive to combustion in the post catalytic combustion stage 24 may be configured to control the portions 30, 42 of the combustible fuel provided to the catalytic stage 22 and post catalytic combustion stage 24, respectively. For example, as a result of using a lower BTU fuel in the gas turbine, combustion conditions in the post catalytic combustion stage 24 may be different from combustion conditions using a higher BTU fuel. The controller 34 may be configured to monitor changes in parameters (for example, as a result of using a lower BTU fuel) such as temperature, oxides of nitrogen (NOx) emission, a carbon monoxide (CO) emission, and/or a pressure oscillation and to adjust the portions 30, 42 supplied to the respective stages 22, 24. For example, an amount of the second portion 42 supplied to the post catalytic combustion stage 24 may need to be increased when using a lower BTU fuel to more than that required when using a higher BTU fuel. The controller 34 may be configured to independently control valves 31 and 41 via respective control signals 33 and 43, to regulate flows 30, 42 in response to sensed combustion parameters. In another aspect of the invention, the controller 34 may be responsive to a sensor 47 sensing a temperature of the catalytic material 38 to control the portions 30, 42 of the combustible fuel provided to the catalytic stage 22 and post catalytic combustion stage 24, respectively. Other parameters indicative of combustion operations in the combustor 23 may also be monitored to determine an appropriate apportioning of the portions 30, 42 provided to the respective stages 22, 24 to achieve desired combustion conditions, for example, based on a BTU rating of a fuel used to fire the combustor 23. If the combustor 23 is fueled with a fuel having a BTU rating within a predetermined range, it may not be necessary to provide the portion 42 of fuel and/or the portion 20 of the oxidizer to the post catalytic combustion stage 24. In another aspect, the portion 20 of the oxidizer provided to the injector scoop 54 may be controlled by an air control valve 72, such a hinged flap, operable to selectively control the portion 20 of the oxidizer entering the scoop 54. For example, when using a fuel with a high BTU value, the air control valve 72 may be closed. When firing the combustor with a low BTU value fuel, the air control valve 72 may be opened to allow a desired flow of the portion 20 of the oxidizer to enter the scoop 54.

In the post catalytic combustion stage 24, the post catalytic combustion mixture 44 and the partially combusted mixture 40 are mixed and further combusted to produce a hot combustion gas 46. A turbine 48 receives the hot combustion gas 46, where it is expanded to extract mechanical shaft power. In one embodiment, a common shaft 50 interconnects the turbine 48 with the compressor 12 as well as an electrical generator (not shown) to provide mechanical power for compressing the ambient air 14 and for producing electrical power, respectively. An expanded combustion gas 52 may be exhausted directly to the atmosphere, or it may be routed through additional heat recovery systems (not shown).

Figure 2:
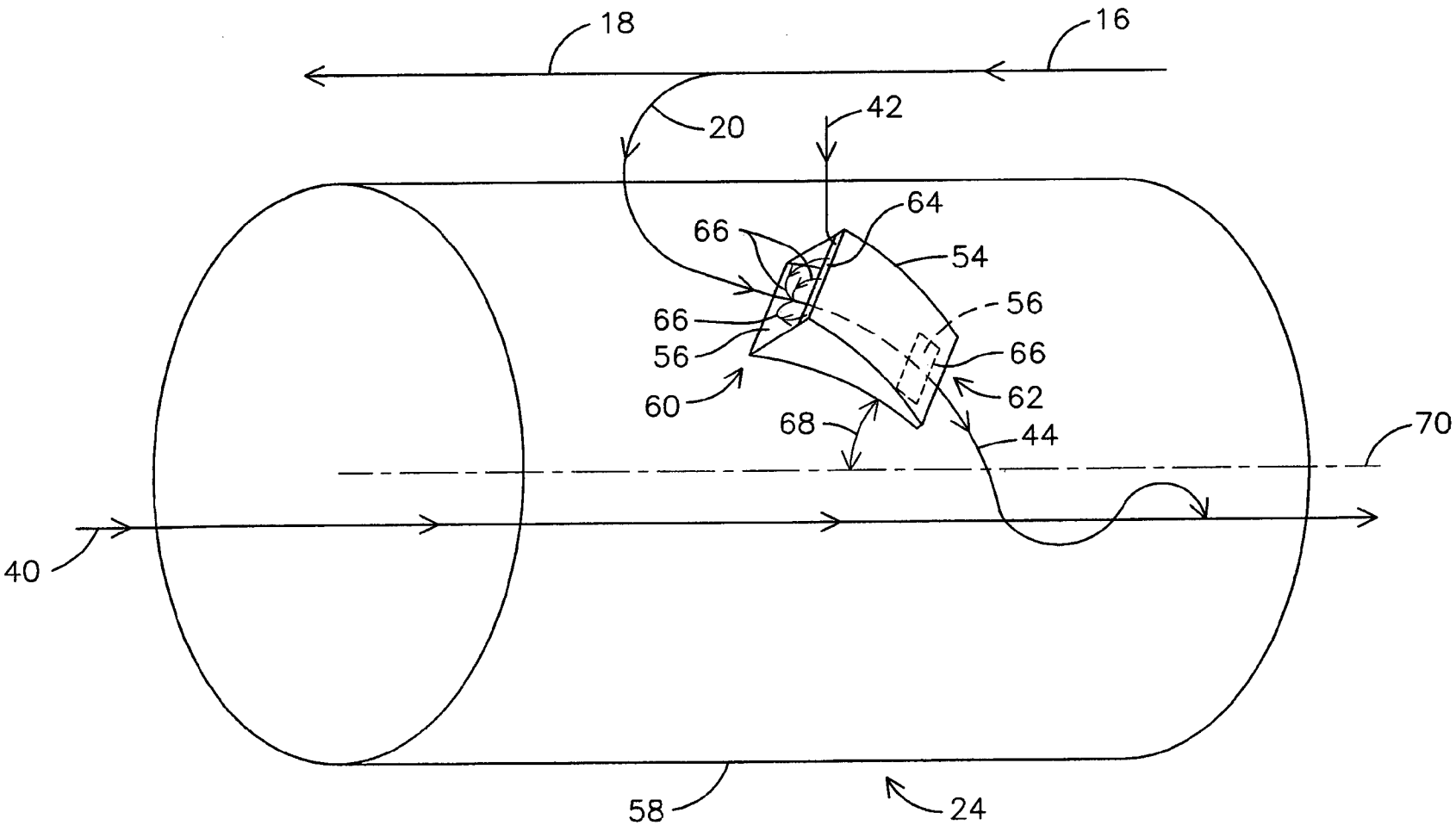
FIG. 2 shows an injector scoop in fluid communication with an opening in a combustion liner of the post catalytic combustion stage of FIG. 1.

FIG. 2 shows an injector scoop 54 in fluid communication with an opening 56 in a combustion liner 58 of the post catalytic combustion stage 24 of FIG. 1. The injector scoop 54 may be disposed to receive the second portion 20 of the oxidizer flow 16 flowing around an exterior of the combustor liner 58, while the first portion 18 may be directed to travel further upstream for introduction into a catalytic combustor stage (not shown). In an embodiment, the second portion 20 may comprise 15% to 20% by volume of the oxidizer flow 16, while the first portion 18 may comprise 80% to 85% by volume of the oxidizer flow 16. A fuel manifold 64 may be located in the scoop 54 for receiving the second portion 42 of the fuel 29 and injecting the second portion 42 into the second portion 20 of the oxidizer flow 16 to produce the post catalytic combustion mixture 44. For example, the fuel manifold 64 may be located at the inlet 56 of the coop 54 to direct a plurality of fuel jets 66 into the second portion 20 of the oxidizer low 16. In an aspect of the invention, the fuel jets 66 may be oriented to direct fuel perpendicularly into a flow direction of the second portion 20 of the oxidizer flow 16.

The scoop 54 includes an outlet 66 in fluid communication with the opening 56 of the combustion liner for discharging the post catalytic combustion mixture 44 into the post catalytic combustion stage 24 to mix with the partially combusted mixture 40 flowing therethrough. In an aspect of the invention, the scoop 54 may be disposed at an angle 68 relative to a flow axis 70 through the post catalytic combustion stage 24 to impart a swirl, or helical motion, to the partially combusted mixture 40 as the post catalytic combustion mixture 44 enters the post catalytic combustion stage 24. For example, the scoop may be disposed at an angle 68 between 15 degrees to 45 degrees relative to the flow axis 70. By injecting the post catalytic combustion mixture 44 at an angle to the flow axis 70 (instead of injecting the post catalytic combustion mixture 44 coaxially with the flow axis 70), improved mixing of the two mixtures 40, 44 may be achieved, thereby improving flame stability. In an embodiment, a plurality of scoops 54 may be disposed circumferentially around the combustor liner 58 to inject the post catalytic combustion mixture 44 into the post catalytic combustion stage 24 through corresponding openings 56 in combustor liner 58.

In an aspect of the invention, the injector scoop 54 may be configured as a ram injector scoop 54 configured to increase a velocity of a fluid flow therethrough. For example, an inlet 56 of the scoop 45 may comprise a larger cross sectional area than a cross sectional area of the outlet 56 so that a total velocity magnitude of the post catalytic combustion mixture 44 entering the post catalytic combustion stage 24 is accelerated to be greater than a velocity of an axial velocity of the partially combusted mixture 40 to avoid flame holding at the scoop outlet within the post catalytic combustion stage 24. In an embodiment, the scoop 54 may be formed in the shape of a wedge having an inlet 56 at an upstream end 60 of the wedge and tapering to a thinner cross section at a downstream end 62. The scoop 54 may be formed integrally with the combustor liner 58 or may be fabricated separately and attached to the combustor liner 58, such as by brazing or welding.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

We claim as our invention:

1. A combustor comprising:

a catalytic combustion stage receiving a first portion of a total oxidizer flow and a first portion of a total fuel flow and discharging a partially combusted fuel/oxidizer mixture;

a post catalytic combustion stage defined by a combustion liner and receiving the partially oxidized fuel/oxidizer mixture along a flow axis;

an injector scoop in fluid communication with an opening in the combustion liner and having an injector scoop inlet for receiving a second portion of the total oxidizer flow;

a fuel outlet selectively supplying a second portion of the total fuel flow into the second portion of the oxidizer flow; and an injector scoop outlet in fluid communication with the post catalytic combustion stage and discharging a fuel/oxidizer mixture of the second portion of the total oxidizer flow and the second portion of the total fuel flow into the partially combusted fuel/oxidizer mixture at an angle relative to the flow axis to impart a swirl to the fuel/oxidizer mixture as it enters the post catalytic combustion stage;

wherein the injector scoop inlet comprises a larger cross sectional area than a cross sectional area of the injector scoop outlet to accelerate the fuel/oxidizer mixture entering the post catalytic combustion stage to a velocity greater than a velocity of the partially combusted fuel/oxidizer mixture to avoid flame holding.

2. The combustor of claim 1, further comprising a metering valve, responsive to a valve control signal, positioned in a flow path of the second portion of the total fuel flow for regulating the second portion of the total fuel flow provided to the injector scoop.

3. The combustor of claim 2, further comprising a controller for generating the valve control signal in response to a combustion parameter.

4. The combustor of claim 1, wherein the angle is 15 degrees to 45 degrees.

5. The combustor of claim 1, wherein the second portion of the oxidizer flow is 15% to 20% by volume of the total oxidizer flow.

6. The combustor of claim 1, further comprising:

a control valve in fluid communication with the injector scoop and effective to control a relative portion of the total oxidizer flow that is directed to be the second portion of the total oxidizer flow.

7. A combustor comprising:

an upstream combustion stage discharging a partially oxidized fuel/oxidizer mixture;

a downstream combustion stage defined by a combustion liner and receiving the partially oxidized fuel/oxidizer mixture along a flow axis;

an ram injector scoop in fluid communication with an opening in the combustion liner and injecting a fuel/oxidizer mixture into the partially oxidized fuel/oxidizer mixture, the ram injector scoop comprising a scoop inlet having a larger cross sectional area than a cross sectional area of a scoop outlet to accelerate the fuel/oxidizer mixture entering a post catalytic oxidation stage.

8. The combustor of claim 7, wherein the ram injector scoop is disposed to inject the fuel/oxidizer mixture into the partially combusted fuel/oxidizer mixture at an angle relative to the flow axis to impart a swirl to the fuel/oxidizer mixture as it enters the combustion stage.

9. The combustor of claim 7, further comprising a flow control valve in fluid communication with the ram injector scoop for controlling a flow rate of the fuel/oxidizer mixture that is injected into the partially oxidized fuel oxidizer mixture.

10. A method of combustion comprising:

providing a first portion of a total oxidizer flow and a first portion of a total fuel flow to a catalytic combustion stage;

injecting a fuel oxidizer mixture a comprising a second portion of the total oxidizer flow and a second portion of the total fuel flow into a ram injector scoop comprising a scoop inlet having a larger cross sectional area than a cross sectional area of a scoop outlet to accelerate the fuel/oxidizer mixture into a post catalytic combustion stage disposed downstream of the catalytic combustion stage;

monitoring a parameter responsive to combustion in the post catalytic combustion stage; and controlling the first portion of the fuel flow and the second portion of the fuel flow in response to the parameter.

11. The method of claim 10, wherein the parameter is selected from the group consisting of a temperature, an oxide of nitrogen (NOx) emission, a carbon monoxide (CO) emission, and a pressure.

12. The method of claim 10, further comprising:

monitoring a catalyst temperature of a catalyst disposed in the catalytic combustion stage; and controlling the first portion of the fuel flow and the second portion of the fuel flow in response to the catalyst temperature.

13. The method of claim 10, further comprising controlling relative portions of the first and second portions of the total oxidizer flow in response to the parameter.

* * * * *